US012790804B2

(12) United States Patent
Lindsey et al.

(10) Patent No.: US 12,790,804 B2
(45) Date of Patent: Nov. 10, 2026

(54) DRAIN CLEANING MACHINE

(71) Applicant: MILWAUKEE ELECTRIC TOOL CORPORATION, Brookfield, WI (US)

(72) Inventors: Jacob K. Lindsey, Milwaukee, WI (US); Ka Seng Lim, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 281 days.

(21) Appl. No.: 18/695,644

(22) PCT Filed: Oct. 7, 2022

(86) PCT No.: PCT/US2022/045987
§ 371 (c)(1),
(2) Date: Mar. 26, 2024

(87) PCT Pub. No.: WO2023/059852
PCT Pub. Date: Apr. 13, 2023

(65) Prior Publication Data

US 2024/0384516 A1 Nov. 21, 2024

Related U.S. Application Data

(60) Provisional application No. 63/253,192, filed on Oct. 7, 2021.

(51) Int. Cl.
*E03C 1/302* (2006.01)

(52) U.S. Cl.
CPC ..... *E03C 1/302* (2013.01)

(58) Field of Classification Search
CPC ..... E03C 1/302; E03F 9/002; E03F 9/005
See application file for complete search history.

(56) References Cited

U.S. PATENT DOCUMENTS 2,201,733 A 5/1940 Kollmann
2,267,493 A 12/1941 Clotz
(Continued)

FOREIGN PATENT DOCUMENTS

CN 204448762 U 7/2015
CN 208602499 U 3/2019
(Continued)

OTHER PUBLICATIONS

International Search Report and Written Opinion for Application No. PCT/US2022/045987 dated Feb. 9, 2023 (11 pages).
(Continued)

*Primary Examiner* — Shay Karls
(74) *Attorney, Agent, or Firm* — Michael Best & Friedrich LLP

(57) ABSTRACT

A frame is configured to support a drum assembly of a drain cleaning machine. The frame including a lower frame, an upper frame extending substantially vertical from the lower frame, a handle movably coupled to the upper frame between a transport position and a use position, and an actuator moveable between a first position, in which the handle is fixed relative to the upper frame in the transport position or the use position, and a second position, in which the handle is allowed to move relative to the frame. The frame also includes a biasing member biasing the actuator toward the first position.

17 Claims, 8 Drawing Sheets

(56) References Cited

U.S. PATENT DOCUMENTS

| | | | |
|---|---|---|---|
| 2,730,740 | A | 1/1956 | O'Brien |
| 2,926,372 | A | 3/1960 | O'Brien |
| 2,926,775 | A | 3/1960 | O'Brien |
| 2,955,307 | A | 10/1960 | Hunt |
| 3,007,186 | A | 11/1961 | Olsson |
| 3,039,715 | A | 6/1962 | Caperton |
| 3,075,217 | A | 1/1963 | Kollmann |
| 3,077,314 | A | 2/1963 | Caperton |
| 3,093,854 | A | 6/1963 | Silverman |
| 3,162,878 | A | 12/1964 | Agostino |
| 3,222,704 | A | 12/1965 | Ciaccio |
| 3,246,354 | A | 4/1966 | Cooney et al. |
| 3,254,851 | A | 6/1966 | Caperton |
| 3,268,937 | A | 8/1966 | Bollinger |
| 3,451,089 | A | 6/1969 | Carlson et al. |
| 3,451,090 | A | 6/1969 | Presti et al. |
| 3,534,423 | A | 10/1970 | Ratliff |
| 3,608,122 | A | 9/1971 | Ratliff |
| 3,609,788 | A | 10/1971 | Mier |
| 3,747,153 | A | 7/1973 | O'Neill |
| 3,859,687 | A | 1/1975 | Caperton |
| 3,928,885 | A | 12/1975 | Peterson et al. |
| 3,958,293 | A | 5/1976 | Irwin |
| RE30,175 | E | 12/1979 | Mier |
| 4,364,139 | A | 12/1982 | Babb et al. |
| 4,395,791 | A | 8/1983 | Irwin |
| 4,580,306 | A | 4/1986 | Irwin |
| D287,178 | S | 12/1986 | Babb et al. |
| 4,700,422 | A | 10/1987 | Russell |
| 4,718,142 | A | 1/1988 | Wahlers |
| 4,773,113 | A | 9/1988 | Russell |
| 4,914,775 | A | 4/1990 | Kirk |
| 5,031,263 | A | 7/1991 | Babb et al. |
| 5,031,276 | A | 7/1991 | Babb et al. |
| 5,193,242 | A | 3/1993 | Irwin |
| 5,199,129 | A | 4/1993 | Salecker et al. |
| 5,222,270 | A | 6/1993 | Sloter et al. |
| 5,309,595 | A | 5/1994 | Salecker et al. |
| 5,390,389 | A | 2/1995 | Rutkowski et al. |
| 5,535,473 | A | 7/1996 | Maniar |
| 5,622,319 | A | 4/1997 | Babb et al. |
| 5,862,561 | A | 1/1999 | Irwin |
| 5,933,903 | A | 8/1999 | Irwin |
| 5,996,159 | A | 12/1999 | Irwin |
| 6,381,798 | B1 | 5/2002 | Rutkowski et al. |
| 6,618,891 | B2 | 9/2003 | Schmitt |
| 6,618,892 | B2 | 9/2003 | Schmitt |
| 6,626,195 | B1 | 9/2003 | Garman et al. |
| 6,760,948 | B2 | 7/2004 | Schmitt |
| 7,040,331 | B2 | 5/2006 | Garman et al. |
| 7,073,224 | B2 | 7/2006 | Schmitt |
| 7,178,534 | B2 | 2/2007 | Garman et al. |
| 7,222,383 | B2 | 5/2007 | Hale |
| D579,612 | S | 10/2008 | Rutkowski et al. |
| 7,530,363 | B2 | 5/2009 | Garman |
| D595,911 | S | 7/2009 | Rutkowski et al. |
| 7,676,879 | B1 | 3/2010 | Rutenberg et al. |
| 7,757,332 | B1 | 7/2010 | Hale |
| 7,761,948 | B2 | 7/2010 | Irwin |
| 7,889,980 | B2 | 2/2011 | Sooy |
| 7,891,038 | B2 | 2/2011 | Hale |
| 8,046,862 | B2 | 11/2011 | Eisermann et al. |
| 8,060,968 | B2 | 11/2011 | Babb et al. |
| 8,176,593 | B2 | 5/2012 | Gress et al. |
| 8,192,559 | B2 | 6/2012 | Garman |
| 8,413,347 | B2 | 4/2013 | Gress et al. |
| 8,931,131 | B1 | 1/2015 | Feduke |
| 9,884,353 | B2 | 2/2018 | Banholzer et al. |
| 9,975,154 | B1 | 5/2018 | Banholzer et al. |
| 10,151,097 | B2 | 12/2018 | Benedid |
| 10,239,100 | B2 | 3/2019 | Banholzer et al. |
| 10,501,927 | B2 | 12/2019 | Pleasants |
| 10,508,431 | B2 | 12/2019 | Cole et al. |
| 10,618,086 | B2 | 4/2020 | Stoneback et al. |
| 10,626,593 | B2 | 4/2020 | Puzio et al. |
| 2008/0098544 | A1* | 5/2008 | Rutkowski ..... E03F 9/005 15/104.33 |
| 2009/0083915 | A1 | 4/2009 | Cicchelli et al. |
| 2010/0017981 | A1 | 1/2010 | Hamm et al. |
| 2017/0268596 | A1 | 9/2017 | Cole et al. |
| 2017/0284078 | A1* | 10/2017 | Puzio ..... E03F 9/005 |
| 2018/0119406 | A1* | 5/2018 | Scott ..... E03F 9/005 |
| 2018/0147713 | A1 | 5/2018 | Schmauder et al. |
| 2018/0229279 | A1 | 8/2018 | Banholzer et al. |
| 2019/0184438 | A1 | 6/2019 | Chartier et al. |
| 2019/0193128 | A1 | 6/2019 | Banholzer et al. |
| 2019/0210078 | A1 | 7/2019 | Davies et al. |
| 2019/0234451 | A1 | 8/2019 | Lokkinen |

FOREIGN PATENT DOCUMENTS

| | | | |
|---|---|---|---|
| CN | 210597507 | U | 5/2020 |
| DE | 1942086 | U | 7/1966 |
| DE | 202005002976 | U1 | 8/2005 |
| DE | 202009003882 | U1 | 6/2009 |
| EP | 1375763 | A1 | 1/2004 |
| EP | 2662156 | A2 | 11/2013 |

OTHER PUBLICATIONS

Ridgid, "K-400 Drain Cleaning Snake Auger 120-Volt Drum Machine with C-32IW 3/8 in.×75 ft. Cable + 4-Piece Tool Set & GI," <https://www.homedepot.com/p/RIDGID-K-400-Drain-Cleaning-Snake-Auger-120-Volt-Drum-Machine-with-C-32IW-3-8-in-x-75-ft-Cable-4-Piece-Tool-Set-GI-52363/206405033?> web page visited May 19, 2026 (7 pages).

* cited by examiner

DRAIN CLEANING MACHINE

CROSS REFERENCE TO RELATED APPLICATION

This application is a national stage filing under 35 U.S.C. § 371 of International Application No. PCT/US2022/045987 filed on Oct. 7, 2022, which claims priority to U.S. Provisional Patent Application No. 63/253,192 filed on Oct. 7, 2021, the entire content of which is incorporated herein by reference.

FIELD OF THE DISCLOSURE

The present disclosure relates to a drain cleaning machine for cleaning drains, pipes, and other conduits.

BACKGROUND OF THE DISCLOSURE

Drain cleaning machines are used to clean clogs and debris out of drains, sewers, and the like. Smaller drain cleaning machines may be used to clean household drains, such as sinks or shower drains. Typically, drain cleaning machines include a drum and a cable. When the drum is rotated (either via a motor or manually by a handle), friction between an inner surface of the drum and the cable causes the cable to spin to facilitate clearing debris from a drain. The cable can be pulled out of the drum and directed into a drain.

SUMMARY OF THE DISCLOSURE

The present disclosure provides, in one aspect, a frame configured to support a drum assembly of a drain cleaning machine. The frame including a lower frame, an upper frame extending substantially vertical from the lower frame, a handle movably coupled to the upper frame between a transport position and a use position, and an actuator moveable between a first position, in which the handle is fixed relative to the upper frame in the transport position or the use position, and a second position, in which the handle is allowed to move relative to the frame. The frame also includes a biasing member biasing the actuator toward the first position.

The present disclosure provides, in another aspect, a drain cleaning machine including a drum assembly having an outer drum defining an interior of the drum assembly, an inner drum positioned within the outer drum, a drum cover, and a front plate coupled to the inner drum. The front plate being removably coupled to the drum cover to facilitate removal of the front plate and the inner drum from the drum assembly to gain access to the interior. The drain cleaning machine also includes an output shaft coupled to the drum assembly to selectively rotate the drum assembly. The output shaft moveable relative to the drum assembly between a first position, in which the output shaft is rotationally coupled to the drum assembly, and a second position, in which the output shaft is rotationally decoupled from the drum assembly, allowing removal of the front plate and the inner drum from the outer drum.

The present disclosure provides, in another aspect, a drain cleaning machine including a frame having a lower frame, an upper frame extending substantially vertical from the lower frame, and a handle movably coupled to the upper frame between a transport position and a use position. The drain cleaning machine also includes a drum assembly supported by frame. The drum assembly includes an outer drum defining an interior configured to receive a drain cleaning cable, an inner drum positioned within the outer drum, a drum cover, and a front plate coupled to the inner drum. The front plate being removably coupled to the drum cover to facilitate removal of the front plate and the inner drum from the drum assembly to gain access to the interior. The drain cleaning machine further includes a quick release mechanism coupled to the drum assembly and movable between a first position, in which a portion of the quick release mechanism is rotationally coupled to the drum assembly, and a second position, in which the portion of the quick release mechanism is rotationally decoupled from the drum assembly, allowing removal of the front plate and the inner drum from the outer drum.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting. In addition, as used herein, the terms "front", "rear", "upper", "lower", and other directional terms are not intended to require any particular orientation, but are instead used for purposes of description only.

DETAILED DESCRIPTION

Figure 1:
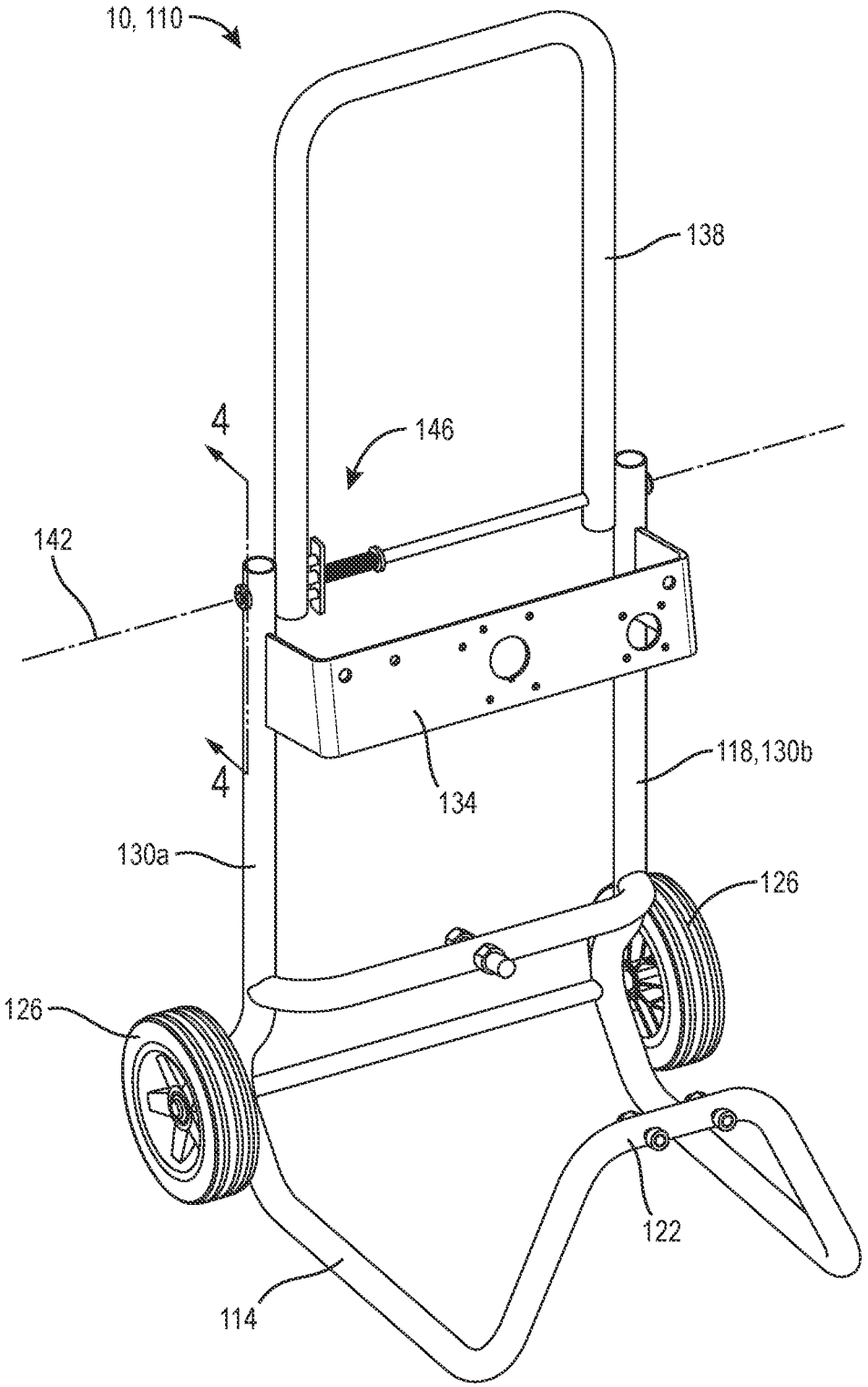
FIG. 1 is a perspective view of a frame of a drain cleaning machine in a transport position.
Figure 2:
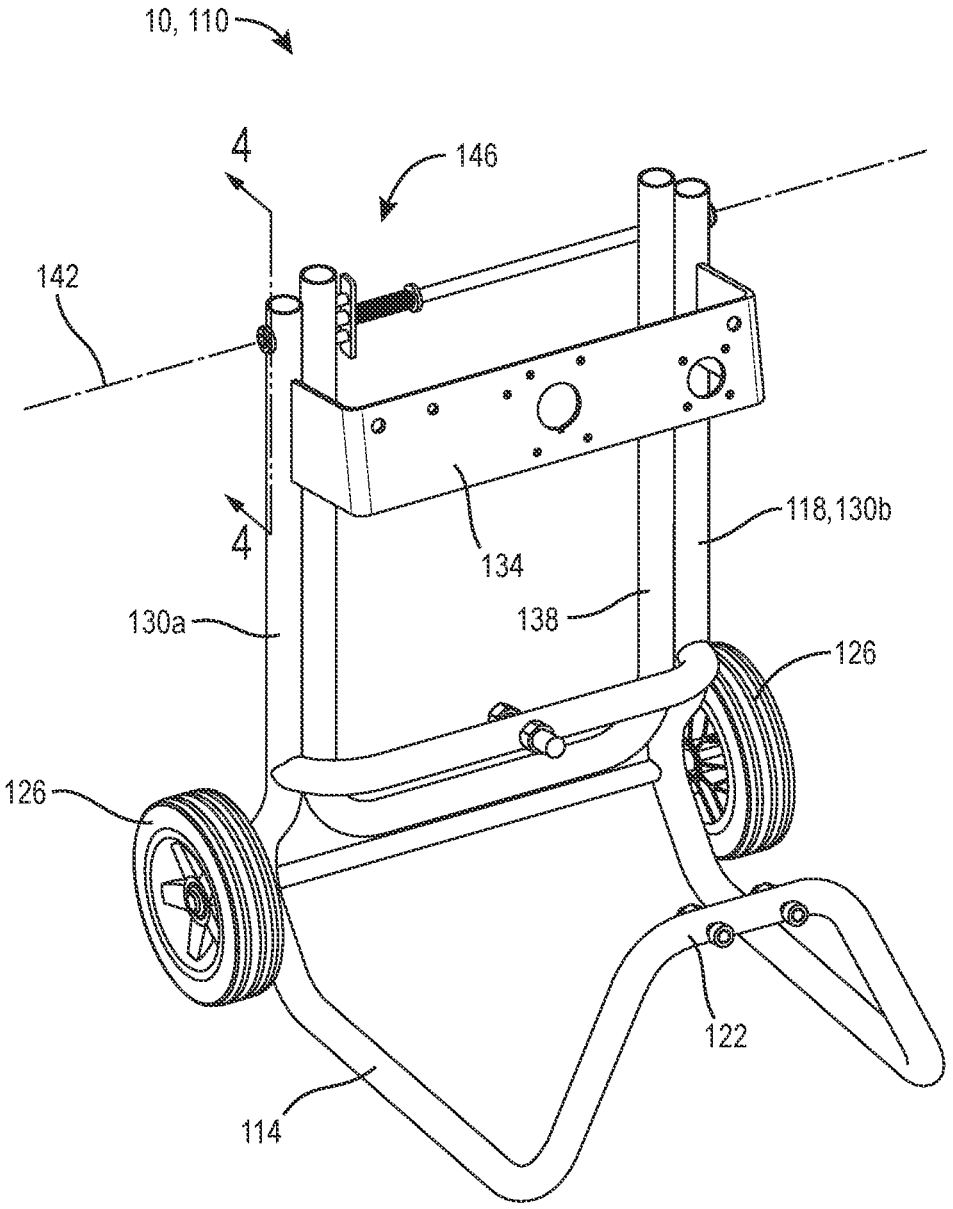
FIG. 2 is a perspective view of the frame of FIG. 1 in a use position.

FIGS. 1 and 2 illustrate a frame 110 to support a drum assembly 112 (FIG. 3) and a motor of a drain cleaning machine 10. The frame 110 includes a lower frame 114 and an upper frame 118. The lower frame 114 extends substantially horizontal relative to a surface the drain cleaning machine 10 is supported on, and the upper frame 118 extends substantially vertical from the lower frame 114. In the illustrated embodiment, the upper and lower frames 114, 118 are integrally formed. For example, the upper and lower frames 114, 118 may be made of bent metal tubes. In other embodiments, the lower and upper frames 114, 118 may be coupled by other means such as fasteners or welding. The lower frame 114 includes a bowed section 122 that supports a lower portion of the drum assembly 112. The bowed section 122 is located at a front of the frame 110. The lower frame 114 also stabilizes the drain cleaning machine 10 when the drain cleaning machine 10 is operating. Wheels 126 are rotatably coupled to the lower frame 114 to facilitate transporting the drain cleaning machine 10 across the surface. The illustrated wheels 126 are located at ends of the lower frame 114 opposite from the bowed section 122. The upper frame 118 includes two vertical uprights 130*a*, 130*b* that are spaced a distance from each other. The vertical uprights 130*a*, 130*b* are located at a back of the frame 110. A bracket 134 extends between the two vertical uprights 130*a*, 130*b*. The illustrated bracket 134 is a generally planar plate. The bracket 134 is bent to project forwardly from the vertical uprights 130*a*, 130*b* over the lower frame 114. The bracket 134 supports an upper portion of the drum assembly 112 and the motor.

The illustrated frame 110 also includes a handle 138. The handle 138 is movable relative to the rest of the frame 110 (e.g., the upper frame 118 and the lower frame 114). In particular, the handle 138 is pivotably coupled to the upper frame 118 about a pivot axis 142. The handle 138 is pivotable about the pivot axis 142 between a transport position and a use position. In the transport position (FIG. 1), the handle 138 may be used to push or pull the drain cleaning machine 10 across a surface. In this position, the handle 138 extends outwardly from the vertical uprights 130*a*, 130*b* of the upper frame 118. In the illustrated embodiment, the handle 138 extends upwardly from the upper frame 118 when in the transport position. As such, tubes (or other members) that form sides the handle 138 are generally parallel to the vertical uprights 130*a*, 130*b*. In other embodiments, the handle 138 may extend horizontally or at an oblique angle from the upper frame 118 when in the transport position. In the use position (FIG. 2), the handle 138 is moved out of the way of the drum assembly 112 so a user may have better access to the drum assembly 112 and other control features of the drain cleaning machine 10. In this position, the handle 138 is positioned between the vertical uprights 130*a*. 130*b* of the upper frame 118. In other words, the handle 138 is received in a space between the vertical uprights 130*a*, 130*b*. The tubes (or other elements) of the handle 138 are again generally parallel to the vertical uprights 130*a*, 130*b*. The use position may also be a storage position where the handle 138 is lowered to make the frame 110 more compact.

Figure 3:
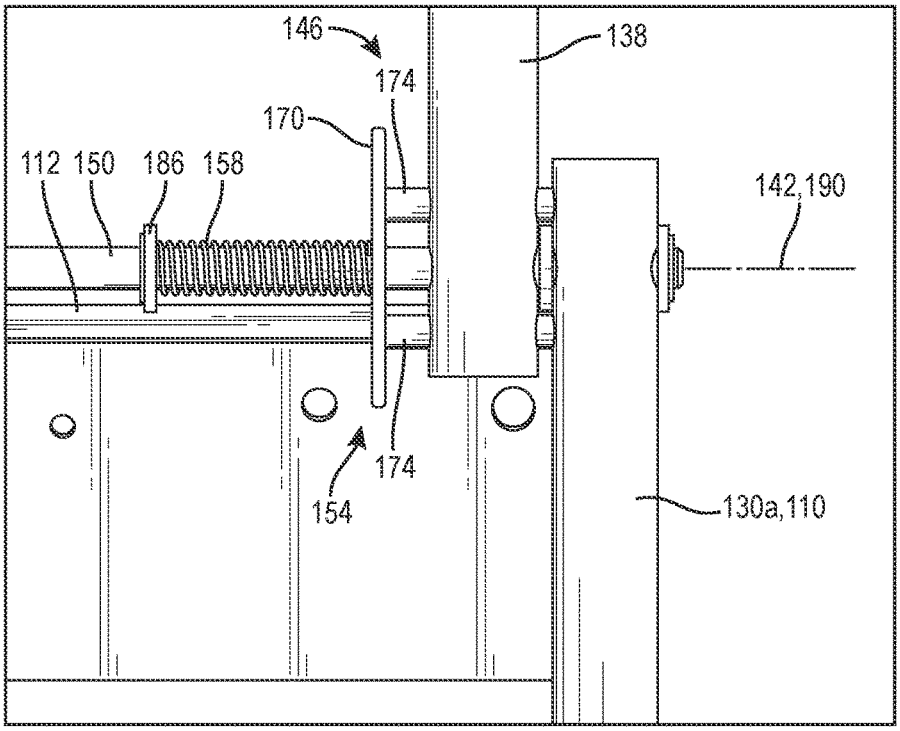
FIG. 3 is a perspective view of an actuator of the frame.
Figure 4:
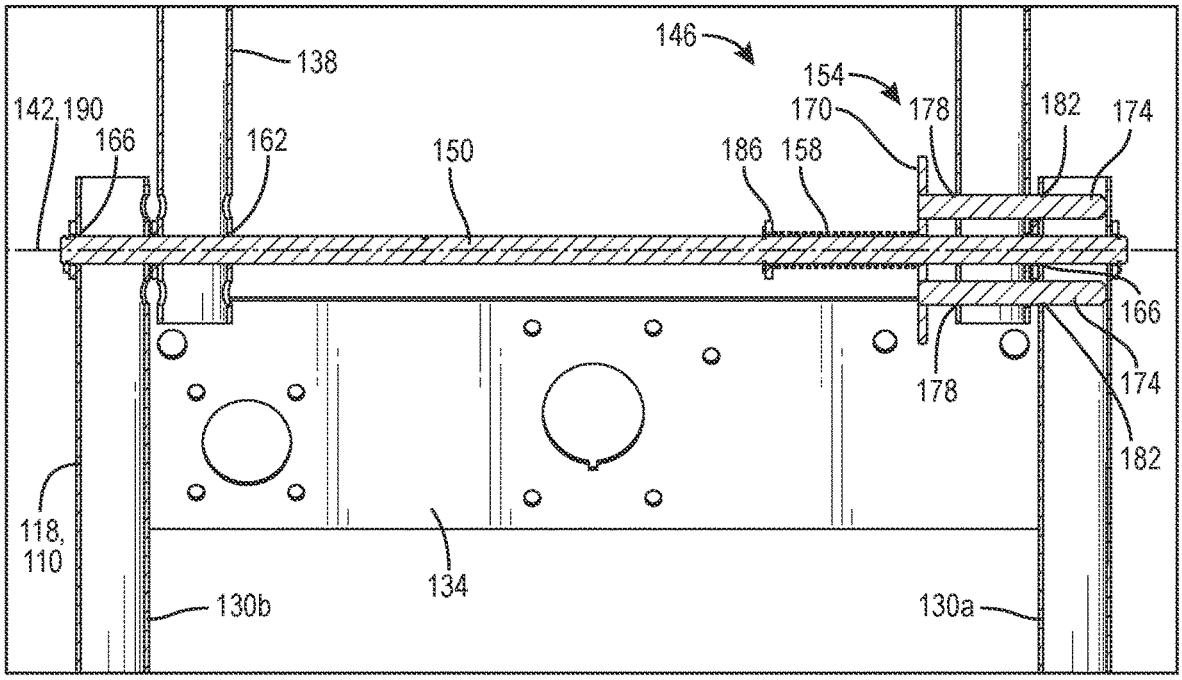
FIG. 4 is a cross-sectional view of the frame taken along lines 4-4 of FIG. 1.

With reference to FIGS. 3-4, the frame 110 includes an actuator 146 that selectively allows pivoting the handle 138 between the transport and the use positions. In the illustrated embodiment, the actuator 146 includes a cross bar 150, a control member 154, and a biasing member 158. The cross bar 150 extends between the two vertical uprights 130*a*. 130*b* of the frame 110. Specifically, the cross bar 150 extends through bores 162 within the handle 138 and bores 166 within the vertical uprights 130*a*, 130*b*. Fasteners (e.g., bolts, washers, etc.) may be used to secure the cross bar 150 to the frame 110. Additionally, the cross bar 150 extends along the pivot axis 142. In other words, the handle 138 is pivotable relative to the frame 110 about the cross bar 150.

The control member 154 is supported on the cross bar 150. The control member 154 includes a grip portion 170 and laterally extending shafts 174 that extend from the grip portion 170. The grip portion 170 may be grasped by a user to move the control member 154 axially along the cross bar 150. The laterally extending shafts 174 extend through apertures 178 in the handle 138 and apertures 182 of the vertical upright 130*a* of the frame 110. In the illustrated embodiment, the control member 154 includes two shafts 174. In other embodiments, the control member 154 may include a single shaft 174 or more than two shafts 174.

The biasing member 158 is supported on the cross bar 150 and is positioned between a retainer 186 and a back side of the control member 154 that is opposite the shafts 174. The biasing member 158 defines a biasing axis 190 that is coaxial with the pivot axis 142. In the illustrated embodiment, the biasing member 158 is a coil spring. In other embodiments, the biasing member 158 may be other resilient members such as a leaf spring. The biasing member 158 biases the control member 154 so that the shafts 174 extend through the apertures 178 in the handle 138 and the apertures 182 in the vertical upright 130*a* of the frame 110.

In operation of the actuator 146, the actuator 146 may be moved between a first position, in which, the handle 138 is fixed or secured relative to the frame 110 (i.e., the transport position or the use position), and a second position, in which, the handle 138 is allowed to pivot relative to the frame 110.

Specifically, to move the handle 138 from the transport position to the use position, a user may move the control member 154 against the bias of the biasing member 158 along the cross bar 150. Once the shafts 174 are removed from the apertures 182 in the vertical upright 130*a* of the frame 110, the handle 138 is operable to pivot about the pivot axis 142 downwards towards the frame 110. When the handle 138 comes to a position where the handle 138 is aligned between the two vertical uprights 130*a*, 130*b* of the frame 110, the biasing member 158 will bias the shafts 174 of the control member 154 back into the apertures 182 of the vertical upright 130*a*. In the use position, the shafts 174 are positioned in opposite apertures 182 than when in the transport position.

To move the handle 138 back to the transport position, a user may again grasp the grip portion 170 and move the control member 154 against the bias of the biasing member 158 along the cross bar 150. Once the shafts 174 are removed from the apertures 182 in the vertical upright 130*a* of the frame 110, the handle 138 may be pivoted about the pivot axis 142 away from the vertical uprights 130*a*, 130*b*. When the handle 138 is in the transport position, the biasing member 158 will bias the shafts 174 of the control member 154 back into the apertures 182 of the vertical upright 130*a*.

Figure 5:
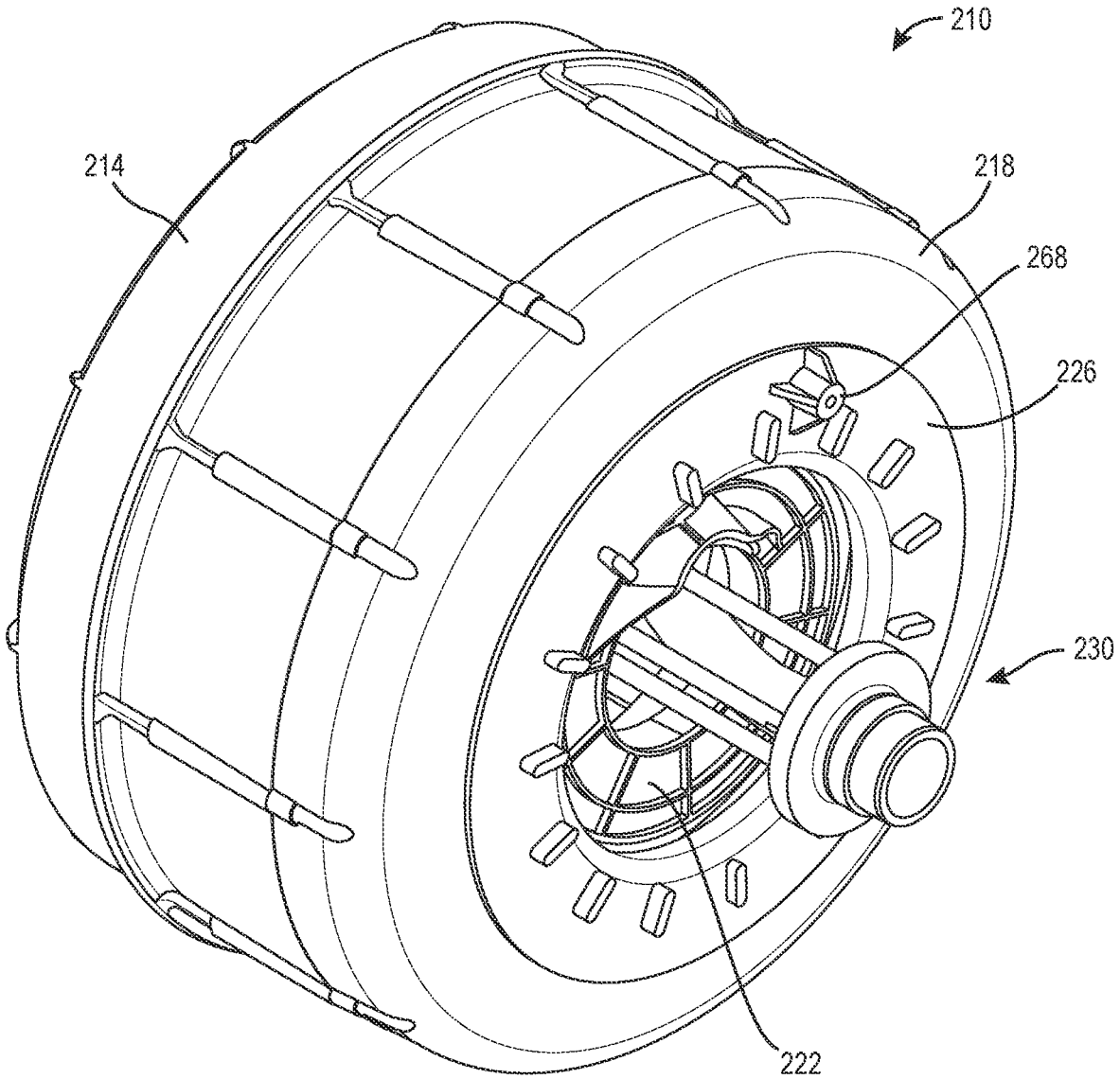
FIG. 5 is a perspective view of a drum assembly of the drain cleaning machine.

FIG. 5 illustrates a drum assembly 210 for use with the frame 110. For example, the drum assembly 210 may be mounted to the bracket 134 (FIG. 1) of the frame 110. Although the drum assembly 210 is described for use with the frame 110 as part of the drain cleaning machine 10, the drum assembly 210 may also be used with other suitable frames. Conversely, the frame 110 may also be used with other suitable drum assemblies.

Figure 6:
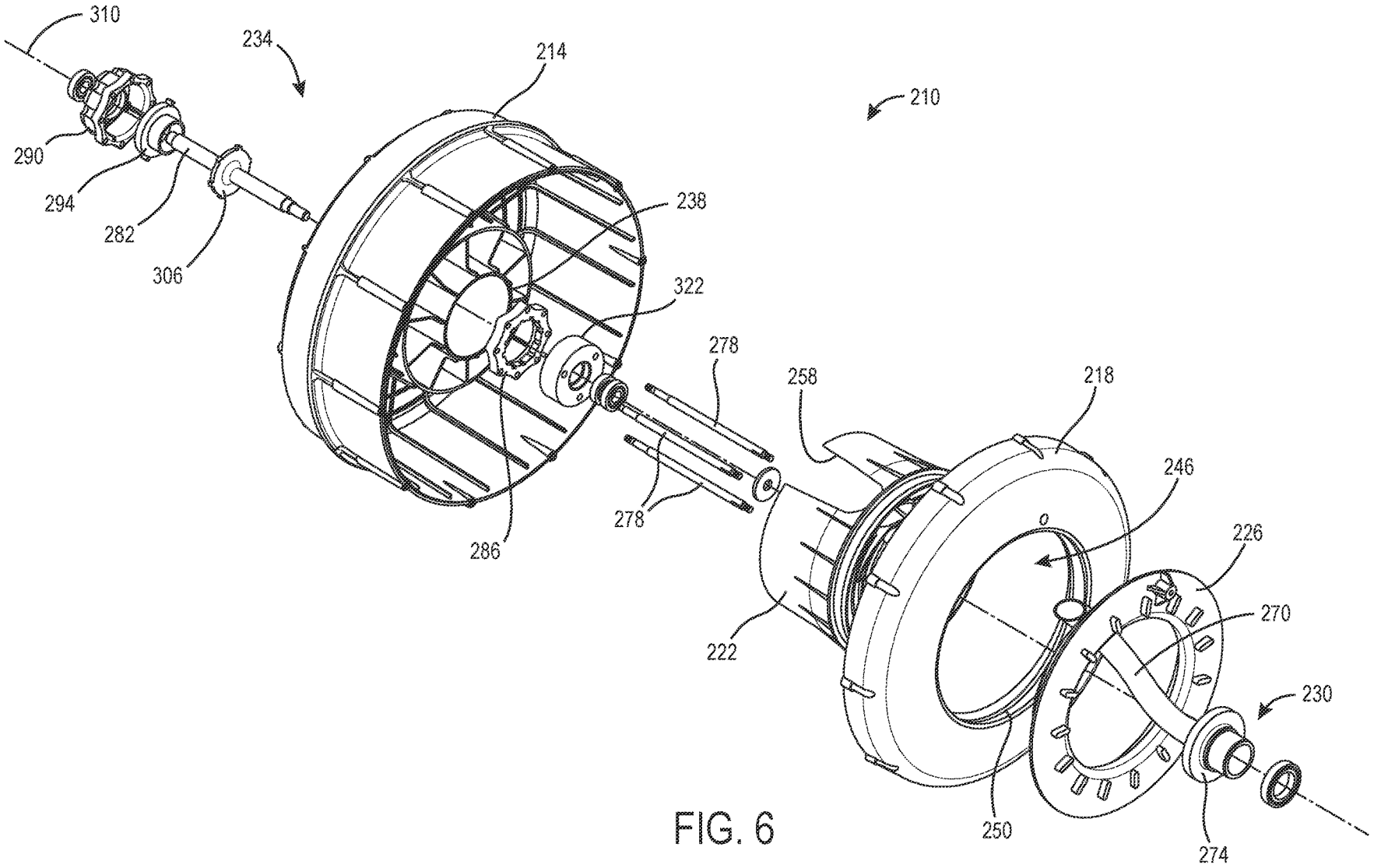
FIG. 6 is a front exploded view of the drum assembly of FIG. 5.
Figure 7:
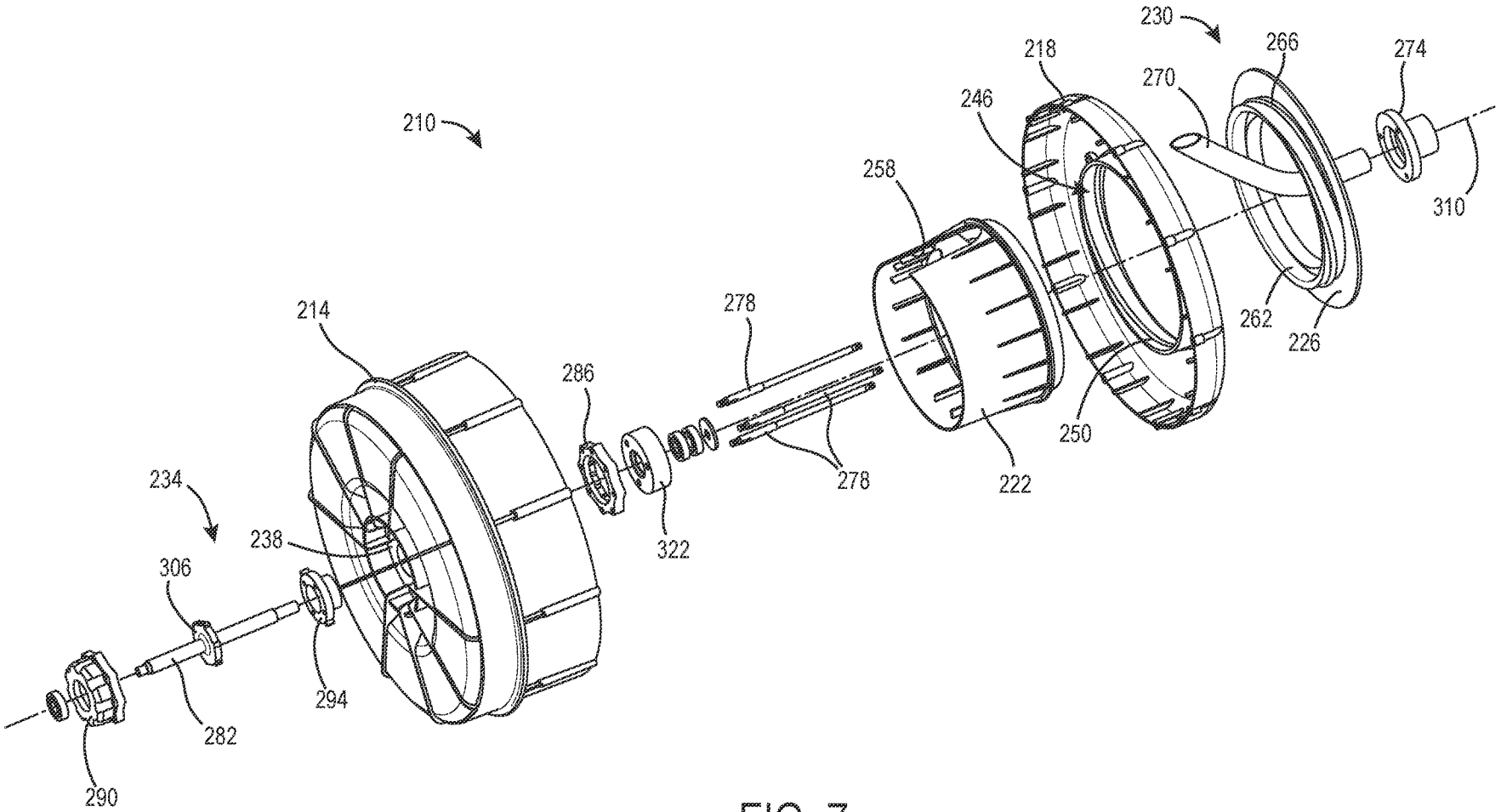
FIG. 7 is a rear exploded view of the drum assembly of FIG. 5.
Figure 8:
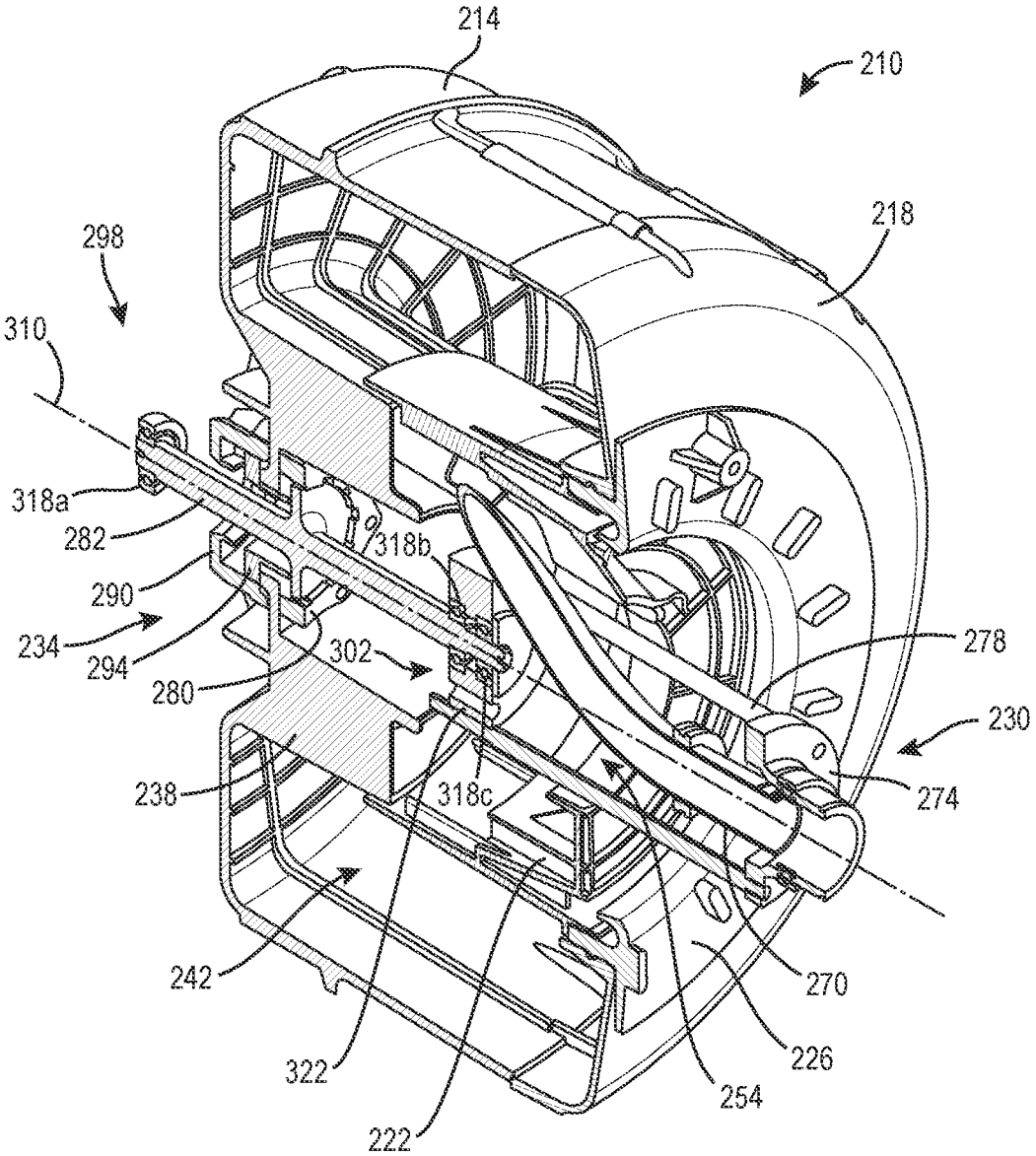
FIG. 8 is a perspective view of a cross-section of the drum assembly of FIG. 5.

With reference to FIGS. 6-8, the illustrated drum assembly 210 includes an outer drum 214, a drum cover 218, an inner drum 222, a front plate 226, a cable guide mechanism 230, and a quick-release mechanism 234. The outer drum 214 and the drum cover 218 may also be referred to as a drum. The outer drum 214 includes a central hub 238 that supports the inner drum 222 and the quick-release mechanism 234. A space 242 (FIG. 8) is defined between the outer drum 214 and the inner drum 222 that supports a drain cleaning cable (not shown). The outer drum 214 may be coupled to the drum cover 218 using fasteners. For example, the outer drum 214 may be coupled to the drum cover 218 by screws, clips, snaps, and the like. The drum cover 218 includes an opening 246 with an inner surface that defines an inner thread 250. The inner drum 222 includes a front opening 254 that the cable guide mechanism 230 extends out of and a recess 258. The front plate 226 engages the inner drum 222 and includes a flange portion 262 with an outer thread 266 that corresponds to the inner thread 250 of the drum cover 218. The front plate 226 also includes a projection 268 (FIG. 5) that facilitates removal of the front plate 226 from the drum assembly 210. As described in more detail below; the front plate 226 and the inner drum 222 can be selectively removed from the drum assembly 210 to gain access to the drain cleaning cable within the drum assembly 210. In some embodiments, the drum assembly 210 may be rotationally driven by an electric motor. The electric motor may be powered by either an A/C power source (e.g., power cord) or a D/C power source (e.g., battery pack).

The cable guide mechanism 230 includes a guide tube 270 and a guide opening flange 274. The guide tube 270 is supported by the inner drum 222 and is positioned with a first end within the recess 258 of the inner drum 222 and a second end extending out of the front opening 254. The second end of the guide tube 270 is also supported by the guide opening flange 274. The guide opening flange 274 is coupled to the quick-release mechanism 234 with a plurality of rods 278. A front end of the drain cleaning cable may extend through the guide tube 270 and out of the guide opening flange 274. The cable guide mechanism 230 assists a user in directing the drain cleaning cable out of the drum assembly 210 and into a drain.

Figure 9:
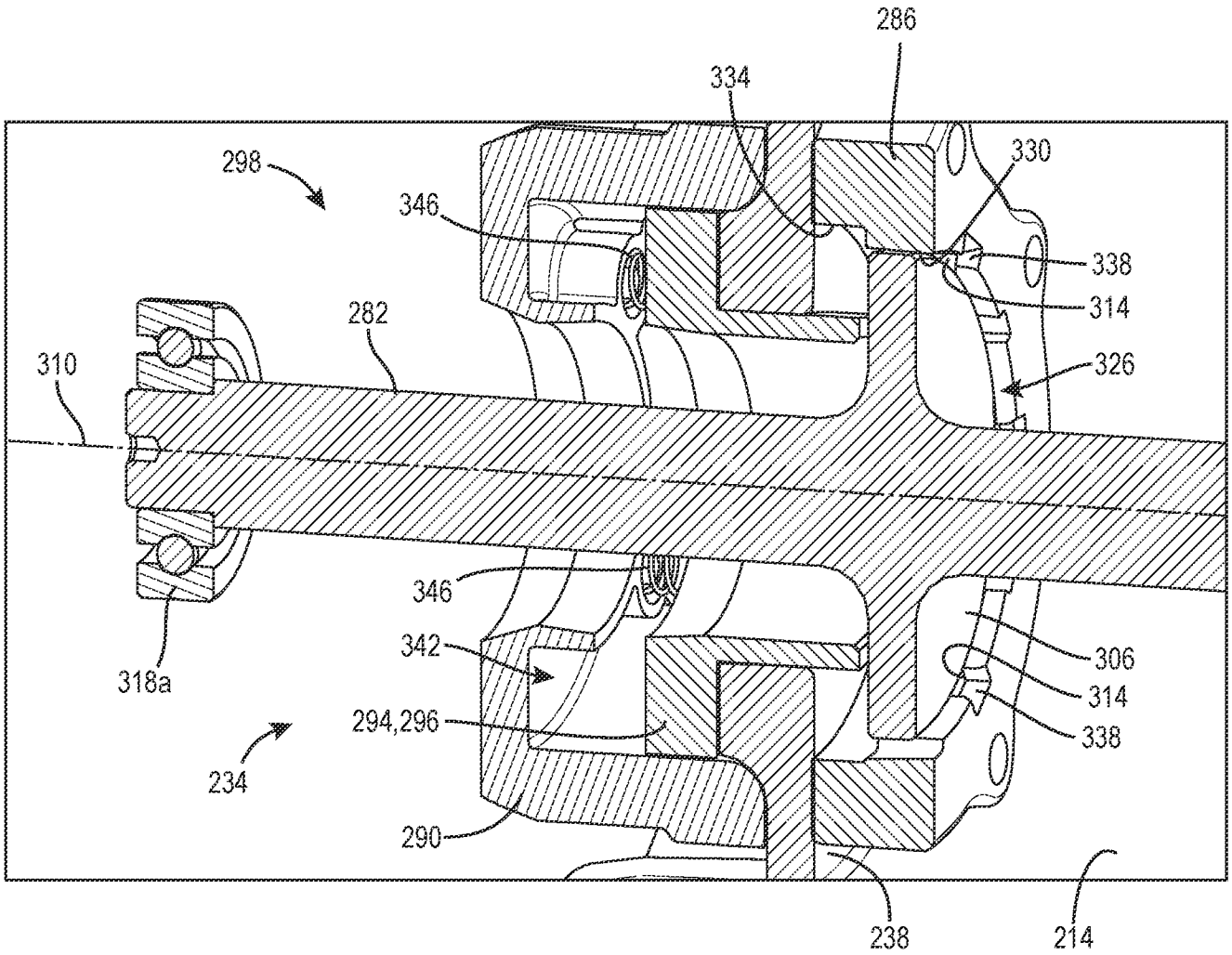
FIG. 9 is a perspective view of a portion of the cross-section of FIG. 8.

Referring to FIG. 9, the illustrated quick-release mechanism 234 includes an output shaft 282, a front ring clamp 286, a rear ring clamp 290, and a biasing assembly 294 positioned between the front and rear ring clamps 286, 290. The output shaft 282 rotationally connects the drum assembly 210 to a motor. Rotation of the output shaft 282 rotates the drum assembly 210, causing the drain cleaning cable to spin. The output shaft 282 includes a first end 298 that couples to the motor, a second end 302 (FIG. 8) that extends into the outer drum 214, and a flange 306 positioned between the first and second ends 298, 302. The output shaft 282 also defines an axis of rotation 310 for the drum assembly 210. The flange 306 is positioned within the outer drum 214 when coupled to the drum assembly 210. The flange 306 includes a plurality of alignment tabs 314 that extend circumferentially about the flange 306. In other embodiments, the flange 306 may include other suitable alignment features. The output shaft 282 is supported by a plurality of bearings 318*a*, 318*b*, 318*c*. A first bearing 318*a* supports the first end 298 of the output shaft 282. Second and third bearings 318*b*, 318*c* (FIG. 8) support the second end 302 of the output shaft 282 within a support disc 322. The support disc 322 threadably receives the rods 278 of the cable guide mechanism 230.

The front ring clamp 286 is coupled to the central hub 238 of the outer drum 214 on an inner side. The front ring clamp 286 includes a bore 326 having a first portion 330 and a second portion 334. The first portion 330 includes a plurality of recesses 338 spaced circumferentially about an inner surface of the first portion 330. The second portion 334 defines an inner surface that has a larger diameter than the inner surface of the first portion 330. The rear ring clamp 290 is coupled to the central hub 238 of the outer drum 214 on an outer side. The rear ring clamp 290 defines a cavity 342 that supports the biasing assembly 294. The biasing assembly includes a biasing flange 296 and a plurality of biasing members 346. A portion of the biasing flange 296 extends from the cavity 342 and into the outer drum 214. The plurality of biasing members 346 (e.g., springs) are seated within the cavity 342. The biasing members 346 bias the biasing flange 296 away from the cavity 342 and towards the flange 306 of the output shaft 282. In other words, the biasing members 346 bias the biasing flange 296 to engage the flange 306 of the output shaft 282 so that the flange 306 is positioned within the first portion 330 of the bore 326 of the front ring clamp 286. When the flange 306 of the output shaft 282 is positioned in the first portion 330 of the bore 326, the alignment tabs 314 of the flange 306 are positioned within the recesses 338 of the first portion 330 of the bore 326. In this position, the output shaft 282 is rotationally locked relative to the drum assembly 210. As such, rotation from the motor can be transferred to the drum assembly 210 when the flange 306 of the output shaft 282 is positioned within the first portion 330 of the bore 326.

During operation of the drum assembly 210, the drain cleaning cable may be extended into and out of the drum assembly 210 to clear debris from a drain or conduit. Simultaneously, rotation of the drum assembly 210 causes friction between and inner surface of the outer drum 214 and the drain cleaning cable which causes the drain cleaning cable to spin. Occasionally, during operation, the drain cleaning cable may become tangled or form knots that may otherwise inhibit the drum assembly 210 from clearing a drain or conduit. A user may need to access the drain cleaning cable in order to untangle the drain cleaning cable.

As mentioned above, the front plate 226 and the inner drum 222 may be removed from the drum assembly 210 to gain access to the drain cleaning cable within the outer drum 214. To gain access to the drain cleaning cable, a user may first grasp the projection 268, or handle, on the front plate 226 and rotate the front plate 226 in a first direction (e.g., counterclockwise) to loosen the outer thread 266 from the inner thread 250 of the drum cover 218. The user can then push on the guide opening flange 274, which moves the output shaft 282 axially against the bias of the biasing members 346. Pushing the output shaft 282 against the bias of the biasing members 346 moves the flange 306 of the output shaft 282 into the second portion 334 of the bore 326 of the front ring clamp 286. When the flange 306 of the output shaft 282 is within the second portion 334 of the bore 326, the drum assembly 210 is rotationally decoupled from the output shaft 282 and prevented from rotating about the axis of rotation 310. With the drum assembly 210 unable to rotate about the axis of rotation 310, a user can remove the inner drum 222 and the cable guide mechanism 230 from the outer drum 214 to gain access to the drain cleaning cable within.

When a user is done accessing the interior of the drum assembly 210, the user can reinsert the inner drum 222 and the front plate 226 and rotate the front plate 226 a second direction (e.g., clockwise) that is opposite from the first direction to couple the front plate 226 to the drum cover 218. Due to the bias of the biasing members 346, the flange 306 of the output shaft 282 is biased back into the first portion 330 of the bore 326 of the front ring clamp 286 and the output shaft 282 is rotationally coupled to the drum assembly 210 again for co-rotation therewith.

Providing a drum assembly with a quick-release mechanism advantageously allows a user to gain access to a drain cleaning cable within the drum assembly. The quick-release mechanism requires no tools in order to remove an inner drum and a front plate allowing for on the spot access to the drain cleaning cable within the drum assembly. A user does not spend time trying to find the appropriate tools to gain access to the inside of the drum assembly.

Although the invention has been described with reference to certain embodiments, variations and modifications exist within the scope and spirit of the invention. Various features and advantages are set forth in the following claims.

What is claimed is:

1. A frame configured to support a drum assembly of a drain cleaning machine, the frame comprising:

a lower frame;

an upper frame extending substantially vertical from the lower frame, the upper frame including a first upright and a second upright opposite the first upright;

a handle movably coupled to the upper frame between a transport position and a use position;

an actuator including a cross bar extending between the first and second uprights of the frame, the actuator moveable between a first position, in which the handle is fixed relative to the upper frame in the transport position or the use position, and a second position, in which the handle is allowed to move relative to the frame, the handle pivotable relative to the upper frame about a pivot axis between the transport position and the use position; and a biasing member supported and wrapped around the cross bar, the biasing member biasing the actuator toward the first position.

2. The frame of claim 1, wherein the actuator is axially moveable against a bias of the biasing member along the pivot axis between the first and second positions.

3. The frame of claim 1, wherein the biasing member is a compression spring.

4. The frame of claim 1, wherein the actuator further includes a control member supported by the cross bar.

5. The frame of claim 4, wherein the control member includes a shaft operable to extend through an aperture in the upper frame when in the first position.

6. The frame of claim 4, wherein the control member is axially moveable along the cross bar to move the actuator between the first and second positions.

7. The frame of claim 6, wherein the biasing member is positioned on the cross bar between the control member and a retainer.

8. The frame of claim 1, further comprising wheels coupled to the lower frame to facilitate transporting the drain cleaning machine across a surface.

9. A drain cleaning machine comprising:

a drum assembly including an outer drum defining an interior of the drum assembly, an inner drum positioned within the outer drum, a drum cover, and a front plate coupled to the inner drum, the front plate being removably coupled to the drum cover to facilitate removal of the front plate and the inner drum from the drum assembly to gain access to the interior;

an output shaft coupled to the drum assembly to selectively rotate the drum assembly, the output shaft moveable relative to the drum assembly between a first position, in which the output shaft is rotationally coupled to the drum assembly, and a second position, in which the output shaft is rotationally decoupled from the drum assembly, allowing removal of the front plate and the inner drum from the outer drum; and a quick-release mechanism including the output shaft and a biasing assembly that biases the output shaft toward the first position, the quick release mechanism further including a front ring clamp coupled to an interior surface of the outer drum and a rear ring clamp coupled to an exterior surface of the outer drum, and wherein the biasing assembly is positioned between the front and rear ring clamps.

10. The drain cleaning machine of claim 9, wherein the output shaft defines an axis of rotation of the drum assembly, and wherein the output shaft is axially moveable along the axis of rotation between the first and second positions.

11. The drain cleaning machine of claim 9, wherein the output shaft includes a flange, and wherein the biasing assembly engages the flange to bias the output shaft toward the first position.

12. The drain cleaning machine of claim 11, wherein the biasing assembly includes a biasing flange and a biasing member that biases the biasing flange into engagement with the output shaft.

13. The drain cleaning machine of claim 9, wherein the drum assembly further includes a cable guide mechanism configured to guide a cable out of the drum assembly.

14. The drain cleaning machine of claim 9, wherein the front plate is rotatable in a first direction to release the front plate from the drum cover, and wherein the front plate is rotatable in a second direction opposite the first direction to secure the front plate to the drum cover.

15. The drain cleaning machine of claim 9, wherein the front plate includes a projection to facilitate removing the front plate and the inner drum from the drum assembly.

16. The drain cleaning machine of claim 9, further comprising a frame to support the drum assembly, the frame including a handle that is movable between a first transport position and a second use position.

17. A drain cleaning machine comprising:

a frame including a lower frame, an upper frame extending substantially vertical from the lower frame and a handle movably coupled to the upper frame between a transport position and a use position, a drum assembly supported by frame, the drum assembly including an outer drum defining an interior configured to receive a drain cleaning cable, an inner drum positioned within the outer drum, a drum cover, and a front plate coupled to the inner drum, the front plate being removably coupled to the drum cover to facilitate removal of the front plate and the inner drum from the drum assembly to gain access to the interior; and a quick release mechanism coupled to the drum assembly and movable between a first position, in which a portion of the quick release mechanism is rotationally coupled to the drum assembly, and a second position, in which the portion of the quick release mechanism is rotationally decoupled from the drum assembly, allowing removal of the front plate and the inner drum from the outer drum, the quick release mechanism including an output shaft having a flange and a biasing assembly that biases the output shaft to keep the quick release mechanism in the first position, the biasing assembly including a biasing flange and a biasing member that biases the biasing flange into engagement with the output shaft.

* * * * *